US007314335B2

(12) United States Patent
Whitsett

(10) Patent No.: US 7,314,335 B2
(45) Date of Patent: Jan. 1, 2008

(54) ANCHOR PILE APPARATUS AND METHOD OF INSTALLATION

(76) Inventor: Michael Whitsett, 106 Ruffian Ct., Bush, LA (US) 70431

( * ) Notice: Subject to any disclaimer, the term of this patent is extended or adjusted under 35 U.S.C. 154(b) by 168 days.

(21) Appl. No.: 10/983,914

(22) Filed: Nov. 8, 2004

(65) Prior Publication Data

US 2005/0100416 A1 May 12, 2005

Related U.S. Application Data

(63) Continuation-in-part of application No. 09/993,321, filed on Nov. 14, 2001, now Pat. No. 6,814,525.

(60) Provisional application No. 60/248,349, filed on Nov. 14, 2000.

(51) Int. Cl.
*E02D 7/22* (2006.01)
*E02D 5/28* (2006.01)

(52) U.S. Cl. ..... 405/233; 405/249; 405/251; 405/253; 52/741.15

(58) Field of Classification Search ..... 405/233, 405/236, 239, 244, 249, 251, 253; 52/741.15, 52/745.12

See application file for complete search history.

(56) References Cited

U.S. PATENT DOCUMENTS

| | | | | | |
|---|---|---|---|---|---|
| 1,962,428 | A * | 6/1934 | Colbie | 405/251 |
| 2,729,067 | A * | 1/1956 | Patterson | 405/236 |
| 3,354,657 | A * | 11/1967 | Turzillo | 405/244 |
| 3,807,184 | A * | 4/1974 | Turzillo | 405/238 |
| 4,915,544 | A * | 4/1990 | Lin | 405/243 |
| 5,066,168 | A * | 11/1991 | Holdeman | 405/249 |
| 5,219,246 | A * | 6/1993 | Coutts et al. | 405/237 |
| 5,707,180 | A * | 1/1998 | Vickars et al. | 405/233 |
| 5,833,399 | A * | 11/1998 | Bullivant | 405/233 |
| 5,919,005 | A * | 7/1999 | Rupiper | 405/244 |
| 5,934,836 | A * | 8/1999 | Rupiper et al. | 405/244 |
| 5,975,808 | A * | 11/1999 | Fujita | 405/244 |
| 2002/0090271 | A1 * | 7/2002 | Saeki et al. | 405/232 |

* cited by examiner

*Primary Examiner*—M. Safavi
(74) *Attorney, Agent, or Firm*—Keaty Professional Law Corporation

(57) ABSTRACT

An anchor pile apparatus has a helical anchor rotatable by a power source through an intermediate drive member. The drive member extends through a plurality of hollow pile sections, which are driven, one by one, into the soil following the penetration of the anchor. In one of the embodiments, the anchor and the pile sections are rotated separately by independent motors, thus expediting the installation of the pile in the pre-determined location.

16 Claims, 7 Drawing Sheets

ANCHOR PILE APPARATUS AND METHOD OF INSTALLATION

CROSS-REFERENCE TO RELATED APPLICATIONS

This application is a continuation-in-part application of my application Ser. No. 09/993,321 filed on Nov. 14, 2001 now U.S. Pat. No. 6,814,525 entitled "Piling Apparatus and Method of Installation," which is a nonprovisional application based on provisional application No. 60/248,349 filed on Nov. 14, 2000, the full disclosures of which are incorporated by reference herein and priority of which is hereby claimed.

BACKGROUND OF THE INVENTION

The present invention relates to an anchor pile apparatus and, more particularly, to an anchor piling apparatus which includes a helical anchor and one or more hollow pile sections adapted for driving into the soil with a surface mounted power source.

The construction and building industries have long used anchor pile devices for providing structural support to buildings in adverse soil conditions. From the beginning, cylindrical disks were used as part of the anchor devices for penetrating the soil and making it ready for the installation of structural pilings. The cylindrical pile devices usually comprise a motor, such as a hydraulic motor, for imparting torque on the anchors to advance the anchors into the competent soil. The cylindrical disks provide the necessary tension and compression of the soil. The original purpose of an earth anchor was to lead the way for the piles, which in the beginning were used for lighter load structures with small diameter shafts and were installed by hand.

With the advent of the hydraulic drive motors, the helical anchors increased in size with much higher tension loads and deeper installation, thus allowing the anchors to reach better soils and achieve much higher tension capacities. About the same time it was discovered that the cylindrical disks on a shaft must also carry compression load in addition to the tension load of the original designs. The development of the helical powered technology led to the use of increasing sizes for the helical disk as well as increasing the shaft size required by the increased demands of poor soil installations. The goal was to achieve higher compression load capacities. With bigger anchor piles, the industry needed bigger installation equipment to combat friction that develops around the larger diameter installation shaft to support the load between the helical disk and the structural applied load.

There also exist conditions where the large anchor pile installation is not feasible. In such cases smaller construction equipment must be used to provide the force necessary to drive the anchor piles into the soil. In such cases, the conventional piling systems are not versatile enough to ensure the sufficient tension and compression force required of the piling system.

The present invention contemplates elimination of drawbacks associated with the prior art and provision of a anchor piling apparatus that uses smaller, more versatile equipment while providing the necessary structural components for a pile-supported structure.

SUMMARY OF THE INVENTION

It is, therefore, an object of the present invention to provide a novel anchor piling apparatus that is capable of enhancing the total overall load capacity of the piling below the ground line.

This and other objects of the present invention are achieved through a provision of an anchor pile apparatus, which can be installed in situ for supporting a structure above the ground. The anchor pile apparatus has a helical anchor connected to a source of rotational force through a rotating drive member. The drive member is positioned inside hollow pile sections, which are connectable end-to-end and the number of which can differ depending on the depth of penetration into the soil. One of the embodiments provides for separate independent source of rotational power for the drive member/anchor assembly and for the pile composed of the plurality of the pile sections.

Once the pile sections reach a pre-determined depth, the connection between the drive member and the anchor is severed, allowing withdrawal of the drive member and its subsequent re-use. The pile sections may be selected to have increasingly greater cross sectional area starting from the lowermost pile section to the uppermost pile section. Once the drive member is withdrawn, the pile sections are filled with self-hardening filler material, which will assume the shape of the internal cross section of the pile sections, thereby increasing structural strength of the piling system.

BRIEF DESCRIPTION OF THE DRAWINGS

Reference will now be made to the drawings, wherein like parts are designated by like numerals and wherein.

DETAILED DESCRIPTION OF THE PREFERRED EMBODIEMENT

Figure 1:
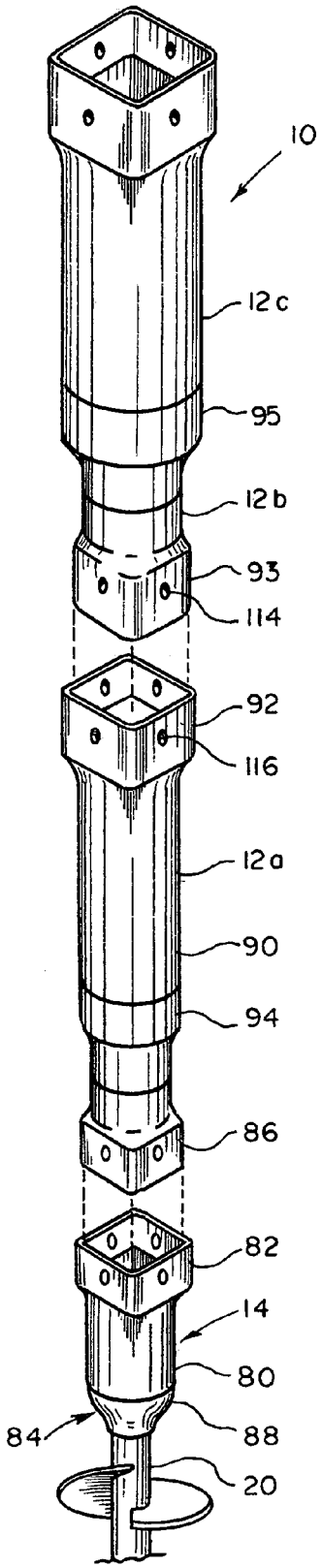
FIG. 1 is a perspective view of the hollow pile sections of the anchor piling apparatus in accordance to the present invention.

Turning now to the drawings in more detail, numeral 10 designates the anchor pile apparatus in accordance with the present invention. The anchor piling apparatus 10 comprises a plurality of hollow pile sections 12 connectable end to end in a substantially coaxial alignment. A hollow transition section 14 forms the lowermost of the pile sections 12. One or ore pile sections 12 may be connected above the transition section 14, depending on the depth of insertion of the pile 10 into the soil.

Figure 2:
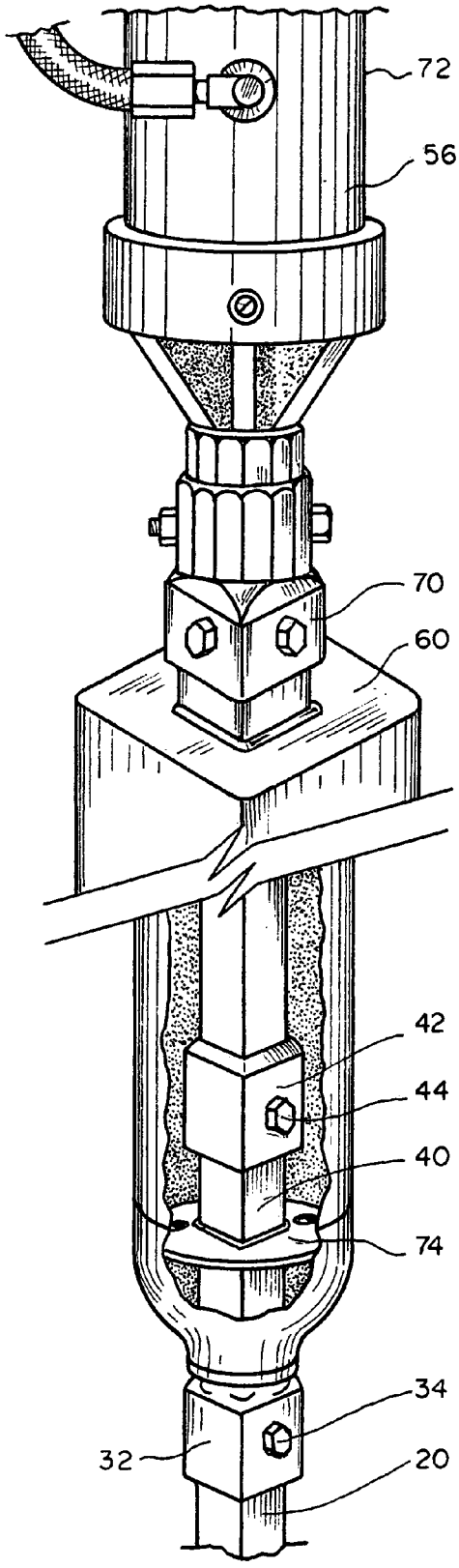
FIG. 2 is a detail, partially cut-away view of the anchor pile apparatus of the present invention, showing the shear pin connecting the anchor and the drive member in a transitional section.

Secured to a lower end 16 and the transition section 14 is a helical anchor 18, which is adapted to be driven into the soil, followed by the transition section 14 and one or more pile sections 12. The anchor 18 comprises an anchor shaft 20, which carries a plurality of helical disks 22. The anchor shaft 20 is operationally connected with a drive member 30 extending inside the pile sections 12. As can be seen in FIG. 2, a lower connector member 32 interconnects the lowermost portion of the drive member 30 with an upper end of the anchor shaft 20. The connector member 32 is provided with a securing means 34 that engage the drive member 30 and the anchor shaft 20 in a detachable relationship.

The drive member 30 comprises a plurality of separate drive shaft members 38, which are connected end to end as the anchor pile apparatus is driven into the soil. Each drive shaft member 38 has an upper and lower end. The lowermost part of the drive member 30, designated by numeral 40 in FIG. 2, extends through the bottom of the transition portion 14 and is operationally connected to the top of the anchor shaft 20. An upper end of the portion 40 telescopically engages with a lower end 42 of the next, adjoining drive shaft member 38. The portion 40 of the drive member 30 is sacrificed during completion of the pile.

A shear pin 44 extends through the wall of the lower end 42 and an upper end of the portion 40. The shear pin 44 is made from a material that is strong enough to withstand downward force acting on the drive member advancing into the soil, while not strong enough to withstand a vertically upwardly directed force imparted on the drive shaft 30 during the completion phase of the pile installation. The shear pin 44 may be made of wood or plastic or other such material that severs when the drive member 30 is pulled out of the pile sections 14 and 12, as will be explained in more detail hereinafter. Subsequent drive shaft members 38 of the drive member 30 are secured end to end and remain connected when the drive member 30 is removed from the pile sections.

Figure 3:
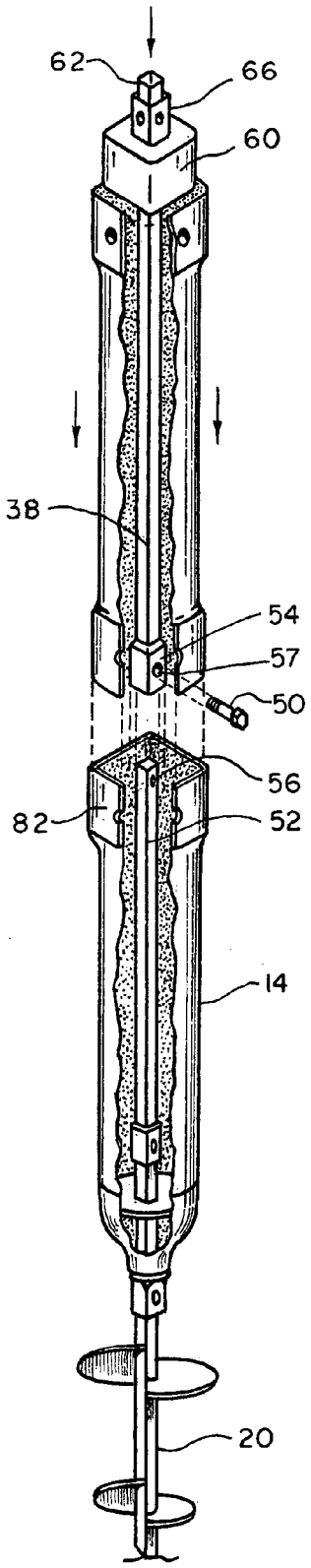
FIG. 3 is a perspective, exploded, partially cut away view showing one of the pile sections being connected to the transition section.
Figure 4:
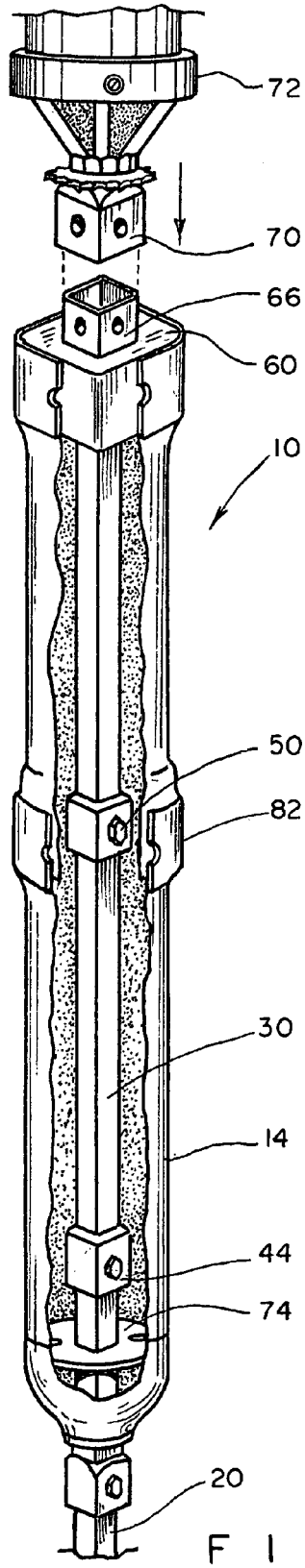
FIG. 4 is a detail, partially cut-away view showing the engagement of the hydraulic drive motor with the drive member.
Figure 5:
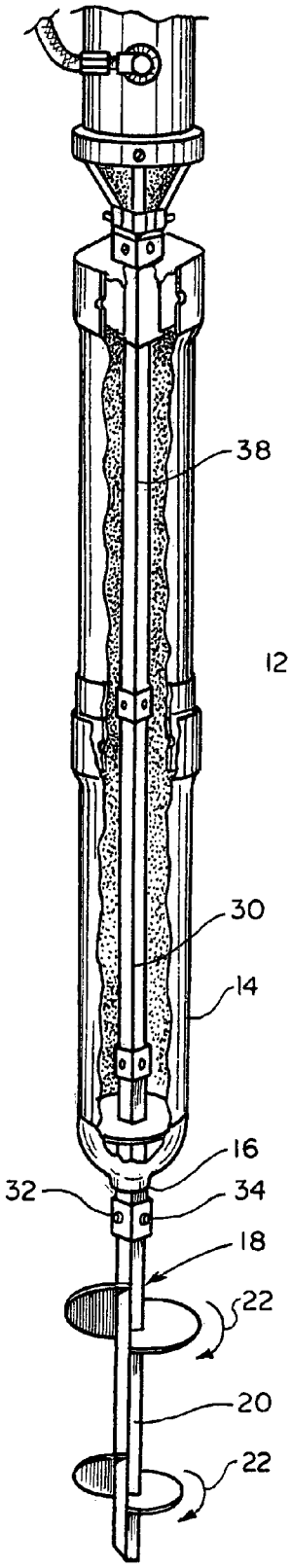
FIG. 5 is a perspective, partially cutaway view illustrating the anchor pile apparatus of the present invention with one transition section and one pile section.

As can be seen in FIG. 3, the lower end 54 of each drive shaft member 38, similar to the end 42, is formed as a female end with an upper end 52 of each drive shaft member 38 formed as a male end, such that a telescopic engagement is made between the drive shaft members 38. When the corresponding openings 56 and 57 of the ends 52 and 54 are aligned, a securing means, such as a bolt 50 is inserted into the openings 56, 57, thereby detachably securing two drive shaft members 38. The drive shaft members 38, similar to the pile sections 12, are connected, one by one, as the anchor pile 10 advances into the soil.

An upper connector member 60 is secured to an upper end 62 of the uppermost drive shaft member 38 of the drive member 30. The upper connector member 60 has a squared sleeve 64 with a central engaging member 66 protruding upwardly therethrough. When the upper connector 60 is lowered onto the upper end 62 of the uppermost drive shaft member 38 of the drive member 30, the end 62 protrudes above the engaging member 66, as shown in more detail in FIG. 3. The engaging member 66 is adapted for making engagement with a drive connector 70, which is part of a power source 72. The power source 72 can be a hydraulic motor or other suitable means of imparting torque to the drive member 30. A transverse plate 74 is welded to the drive shaft portion 40 and then is also welded to the interior of a concentric reducer 88. The transverse plate 74 is located below the shear pin 34 and stabilizes the rotating shaft 30 during operation.

As can be better seen I FIG. 1, the transition member 14 has a generally cylindrical configuration, with a squared upper end 82 and a conical lower end 84. The squared end 82 forms a female connector adapted for mating engagement with a lower squared male end 86 of the lowermost pile section 12*a*. An adapter sleeve, or concentric reducer 88 connects the lower end 84 of the transition section 14 with the central cylindrical portion of the transition section 14.

The lowermost pile section 12*a* has a generally cylindrical middle portion 90 and a squared upper end 92. The upper end 92 is formed as a female end configured to receive a male lower end of the next pile section 12*b* therein. The anchor pile apparatus 10 of the present invention may contain one or more of the pile sections 12, depending on the depth to which the pile is to be driven into the ground.

It is envisioned that the uppermost pile section 12*c* of the pile connector apparatus 10 will have greater cross-sectional area than sections 12*a* or 12*b*. In fact, the cross-sectional area of the pile sections starting from the transition section 14 can be of increasingly greater to allow better compression force to be applied to the soil surrounding the area where the anchor pile 10 is being positioned and make the supported structure more stable.

Adapter sleeves, or concentric reducers 94 and 95, similar to the concentric reducer 88, may be positioned at the junction of connecting pile sections 14 with 12*a* and 12*b* with 12*c*, respectively, as shown in FIG. 1. The concentric reducers 94, 95, similarly to the concentric reducer 88 facilitate smooth connection between adjoining pile sections of increasing cross-sectional areas of the hollow pile sections starting from the lowermost transition section 14 to the uppermost pile section 12*c*. Since the upper ends of each pile section 12 extend upwardly and form female receptacles, the earth, gravel and other debris does not penetrate into the interior of the pile sections 12 thus ensuring an obstacle-free environment for the rotating drive member 30.

Figure 6:
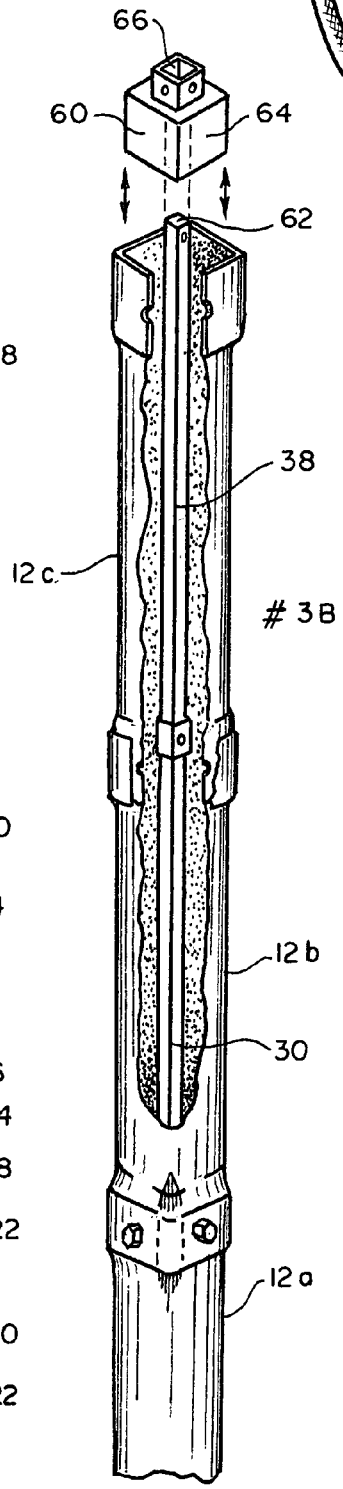
FIG. 6 is a detail, partially cutaway view of the anchor pile apparatus of the present invention illustrating connection of the upper end of the drive member.
Figure 7:
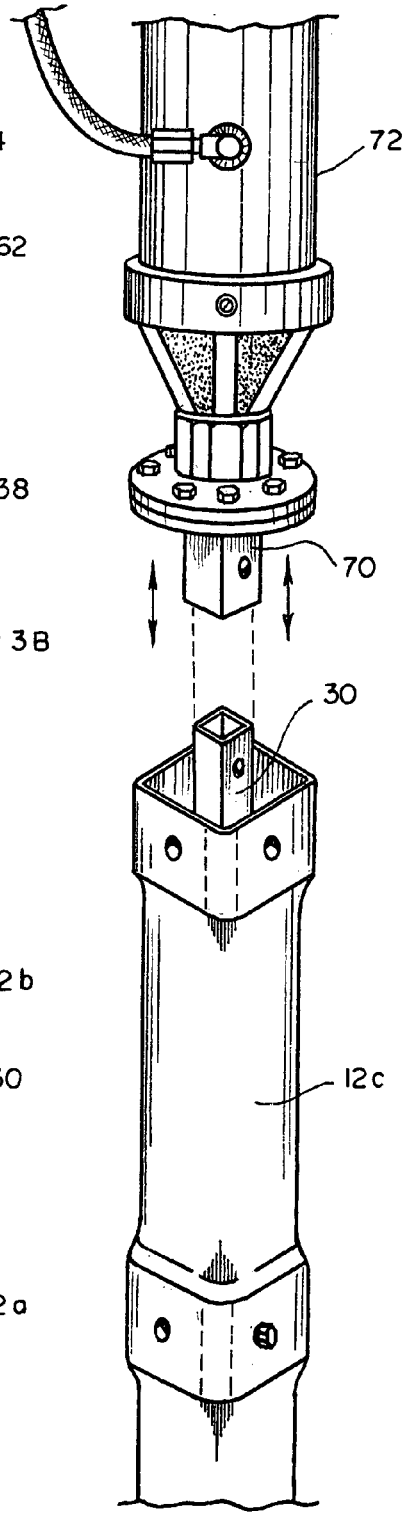
FIG. 7 is a detail view illustrating the drive member protruding above the top of the uppermost pile section, ready to be connected to a power source.
Figure 8:
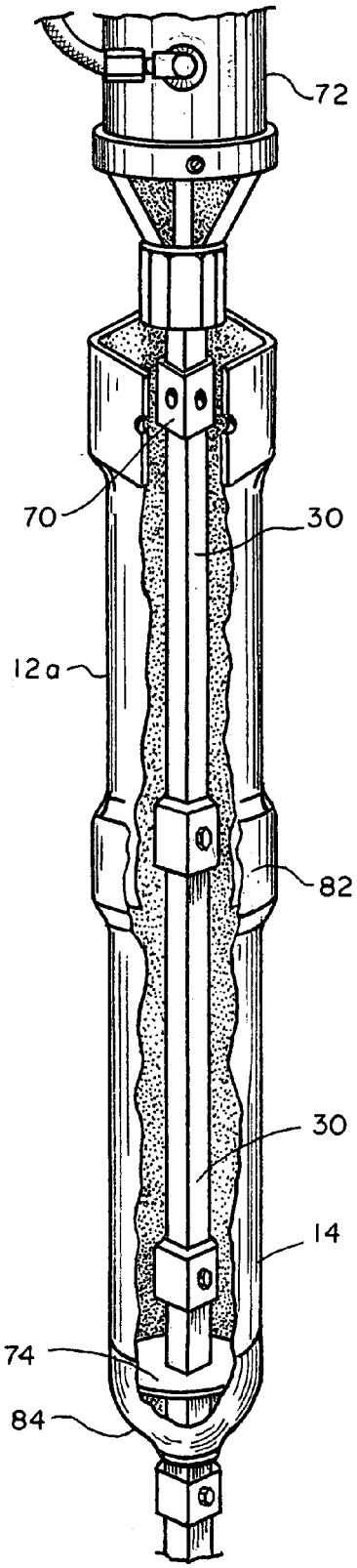
FIG. 8 is a detail, partially cutaway view illustrating the pile sections connected together with the drive member connected to the power source.

Turning now to FIGS. 6 and 7, alternative engagement structures for the drive member 30 with the power source are illustrated. FIG. 6 illustrates the use of the squared connector 60 that is positioned on top of the drive member 30. If desired, the drive member 30 may be engaged directly with the drive tool or drive mandrel 70, which is squared to mate with the square end of the drive member 30. In the embodiment shown in FIG. 8, the drive tool 70 is operationally connected directly to the upper end of the drive member 30 for transmitting torque from the hydraulic motor 72 directly to the drive member 30 and to the helical anchor 18.

Figure 9:
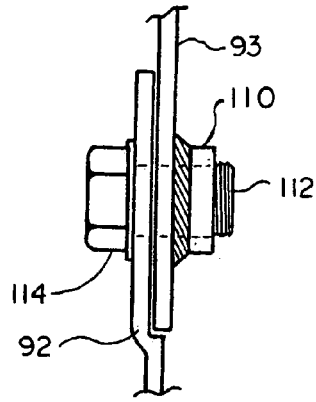
FIG. 9 is a detail view illustrating one method of securing male-female ends of the pile sections.

Turning flow to FIGS. 9-13, alternative methods of securing adjacent pile sections are illustrated in more detail. As can be seen in FIG. 9, a nut 110 is fixedly attached, such as by welding, to the inside surface of the male end 93 of the pile section 12. A bolt 112 passes through correspondingly aligned openings 114 and 116 of the pile section ends 93 and 92 respectively pressed together along their flat surfaces. If desired, a washer 114 can be secured on the exterior side of the bolt 112 for contacting the end 92 of the adjacent pile sections.

Figure 10:
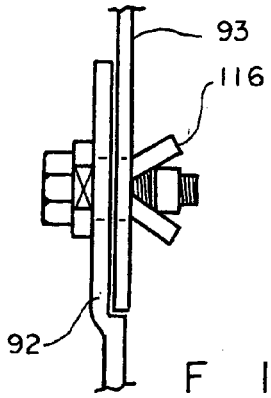
FIG. 10 illustrates a detail of another means of securing the adjacent piles sections.
Figure 11:
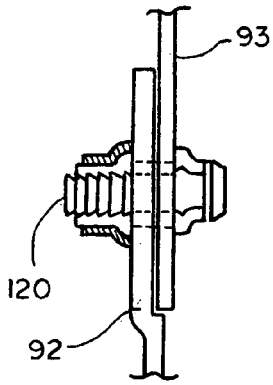
FIG. 11 is a detail view illustrating a third method of connecting the pile sections.
Figure 12:
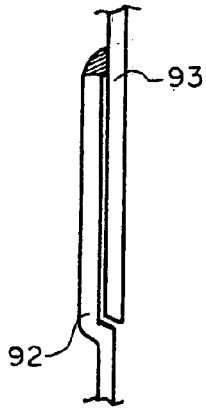
FIG. 12 is a detail view illustrating a fourth method of connecting the pile sections.

FIG. 10 illustrates a detail of another means of securing the adjacent piles sections 12. In this embodiment, a bolt with spreading legs 116 is used for connecting the adjacent ends 93 and 92. Such bolts are known in the industry for securing two hollow metal bodies together. Such bolts are manufactured under the trademark Lindapter® bolts. FIG. 11 illustrates the use of an industrial rivet 118. It is used for positioning on the interior of the section 93, with a bolt 120 extending through the corresponding aligned openings 116 and 114. FIG. 12 illustrates still another method of securing the adjacent pile sections, wherein a lap weld is used completely weld together the square pipe connection. Alternatively, tack welding along the flat side of the two pipe sections 93 and 92 may be used. These securing means facilitate stronger engagement between the flat sides of the pile sections 12, compressing them to each other and creating a much stronger bond of connection as compared to conventional through bolted engagement. The round to square male to female connection allows for mechanical engagement mechanism to apply torque to the pipe section. This connection may be made permanent by welding or temporary, such as by a through bolt, a flange bolt, or a threaded coupling.

With a particular reference to FIGS. 16-18 and 21, the second embodiment of the present invention an anchor pile apparatus 200 is shown comprising a transition section 202 and one or more pile sections 204 extending above the transition section 202. In this embodiment, the drive member 206 is adapted for separate rotation from the rotation of the pile sections 202 and 204. As can be seen in the drawings, the drive member 206 is operationally connected to the helical anchor 208, which extends below the transition section 202. A shear pin 210 is inserted through corresponding openings in the lower part of the drive member 206 and an upper end of the connecting drive shaft portion 212. The function and purpose of the shear pin 210 is similar to the shear pin 44 of the first embodiment of the present invention.

The upper end 220 of the drive member 206 is connected to a first power source 222. The rotating force transmitted from the motor 222, is imparted on the drive member 206 and transmitted to the anchor 208, driving it into the ground.

A second power source 224 is operationally connected, through a drive member 225, to a gear assembly 226, which is mounted on top of an upper plate 228 fixedly engaged with an upper end 230 of the top pile section 204. The rotational force transmitted from the second motor 224 causes the pile sections 202 and 204 to rotate independently and separately from the drive member 206. The helical anchor 208 along with the removable internal drive member 206 can rotate in a clockwise or counter clockwise direction and at a speed of rotation different from the rotation of the pile sections 202 and 204. Additionally, the direction of rotation, clockwise or counter-clockwise can be imparted on the pile sections which will be in the same direction as the rotation of the drive member 206 or different direction, as desired.

The independent rate of rotation and advancement the two main parts will allow the helical anchor to advance into the earth much faster since the rotation of the motor 224 does not have to cause penetration of the pile sections as well. The anchor 208 can cut and displace smaller amounts of soil much faster to the outside edges of the casing followed by the pile sections. This arrangement is different from the industry standards of rotating the helical anchor together with or dragging or pulling the attached casing (pile sections), using one motor, one speed and one direction.

The casing, or the pile sections, is rotated through the gear assembly 226 in a selected direction and a selected speed. It is envisioned that by rotating the drive motors 222 and 224 in opposite directions or opposing directions to each other, may lead to canceling out some of the torque that would be transferred to the installation, allowing for a smaller size of installation equipment to be used when driving the pile 200 into the ground.

This embodiment is believed to be particularly beneficial for use inside of buildings, which have no clearance or where the head area is obstructed. The same process could be used with much bigger equipment outdoors allowing to install larger piles with higher carrying capacities as compared to conventional equipment.

The two separate hydraulic motors allow for an infinite number of adjustments to the pile installation process with varying soil conditions. The torque value normally seen on a single hydraulic drive motor can now be displaced or divided between two drive motors. This will allow more torque to be directed to the helical anchor per se. The second embodiment of the present invention allows to advance the drilling, helical anchor per se at a slower pace while rotating the pile sections at a much faster speed of rotation into the earth while using smaller and more versatile equipment. The second embodiment of the present invention allows the anchor pile to advance into the soil unhampered and unrestrained by the forces of friction that develops from trying to rotate and at the same time pull or drag a large diameter pipe casing deeper into the ground.

If desired, the secondary motor can be mechanically connected and positioned next to the main motor to resist torque and help maintain alignment of the chain drive gear box which was used to drive the square mandrel drive tool secured into the male square end of the casing or pile section. Once the helical anchor and the pile sections reach the desired depth, the two motors may be switched to operate at the same speed of rotation to a complete stop to prevent disturbance of the soil by the helical anchor per se.

Additionally, smaller sized helical anchors can be used to penetrate the soil. The smaller diameter anchors have the ability to penetrate through most of the hardest and more difficult soil conditions, where larger diameter anchors connected to the large casing of the pile sections would not be able to work. A larger diameter lead unit with helical disks translates into high capacity compression pile and tension anchor. Where conventional small diameter solid steel square helical pile systems have difficulty in sustaining a high compression load in deep depths and poor soil conditions, the helical anchors of the present invention, disconnected from the need to rotate large pile sections can assure penetration into harder soils while sustaining full tension required for working in such hard soils. With the use of separately rotating pile sections and the anchor, the torque values can be substantially increased while using slower rotation values and still ensuring high compression pile penetration of the soil.

To further facilitate compression of the surrounding soil, the transition units 14 and 202 of the anchor pile apparatus of the present invention may be provided with longitudinally extending ribs 231, which are secured on the exterior surface of the transition pile section 14 or 202. The ribs 231 may extend along the entire length of the transition section 202 or oniy along a part thereof. Additionally, a plurality of teeth 232 can be secured on the conical parts 84 and 234 of the transition sections 14 and 202. The teeth 232 (FIGS. 16 and 18) can be spaced along a spiral path, radially or in any other desired arrangement along the outer surface of the conical portions 84 and 234. The teeth 232 further enhance penetration capabilities of the anchor pile apparatus 200, especially in hard, rocky soils.

Figure 19:
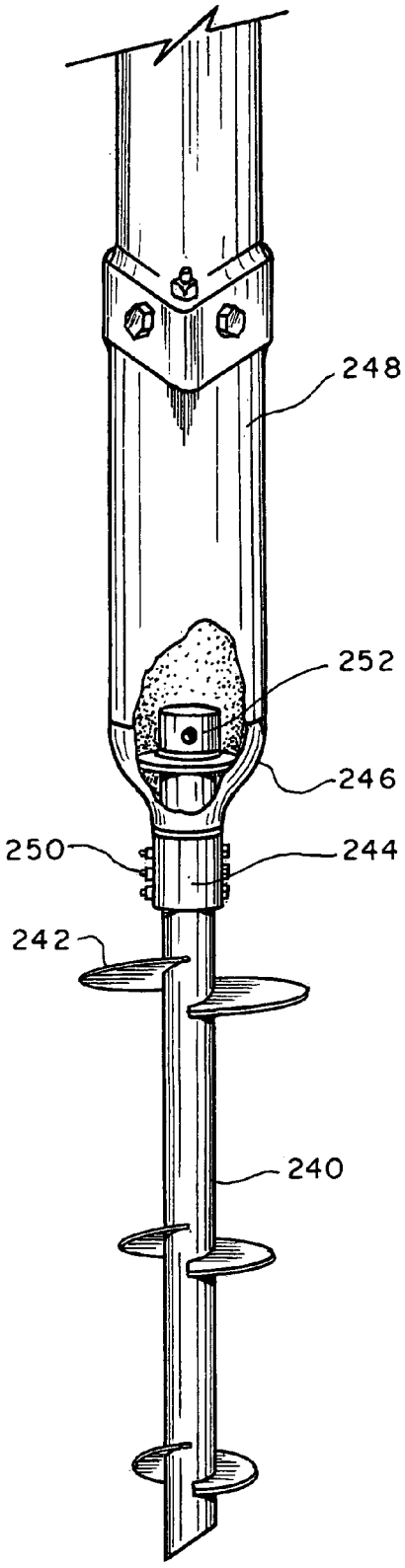
FIG. 19 is a detail, partially cutaway view of n alternative embodiment of the helical anchor portion of the anchor piling apparatus of the present invention using a cylindrical anchor shaft.
Figure 20:
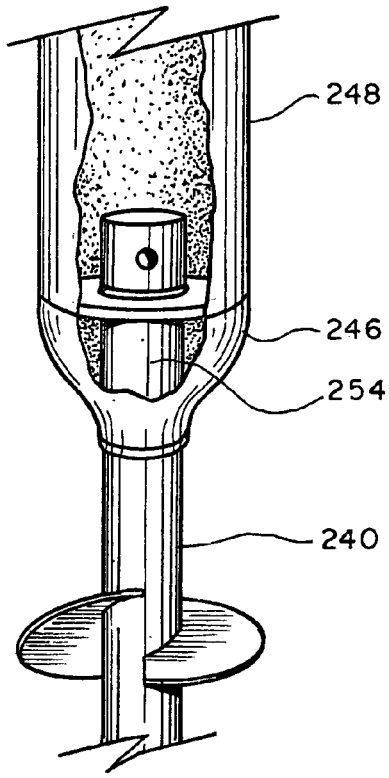
FIG. 20 is a detail view of the anchor shaft of FIG. 19.
Figure 21:
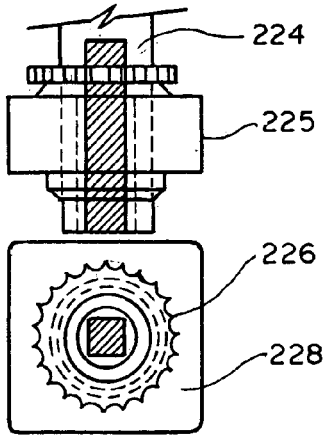
FIG. 21 is a detail top view of the drive gear assembly connected to the uppermost pile section in the second embodiment of the apparatus of the present invention.

Turning now to FIGS. 19 and 20, an alternative design of an anchor shaft is illustrated. In this embodiment, the squared shafts of the anchors 20 and 208 are replaced with a cylindrical shaft 240. A plurality of helical cutting disks 242 is secured on the shaft 240 for penetrating into the soil. An upper connector 244 may be mounted between a conical section 246 above the transition pile section 248. A plurality of bolts 250 may be used to secure the anchor shaft 240 to an internal drive member 252. Alternatively, as shown in FIG. 20, an upper end 254 of the shaft 240 can extend into the conical portion 246 of the transition pile section 248 and be connected to the drive member (not shown) through the engagement inside the transition pile section 248.

Figure 13:
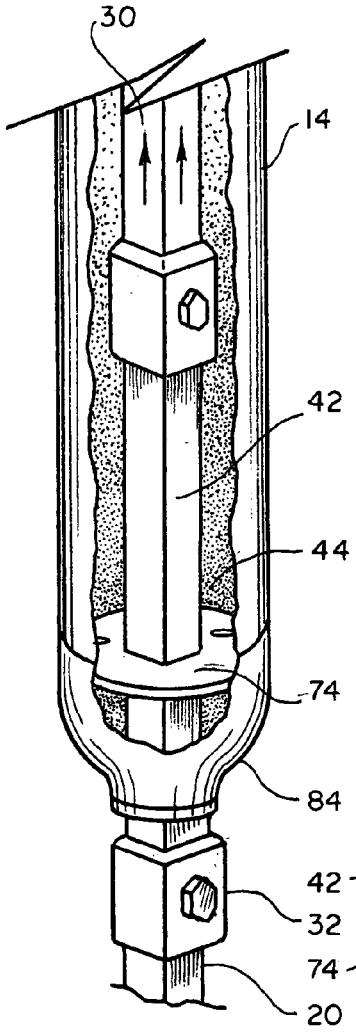
FIG. 13 is a detail view illustrating the position of the shear pins in the transition pile section with the drive member being upwardly.
Figure 14:
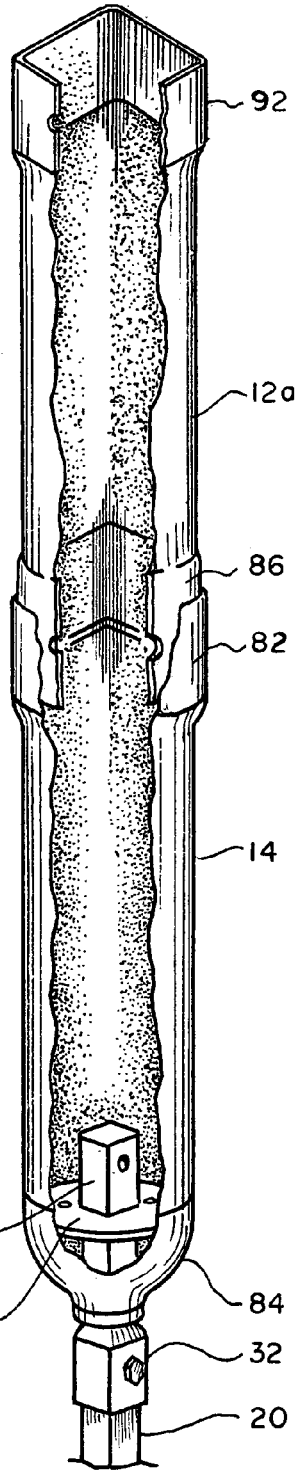
FIG. 14 is a cutaway view illustrating hollow pile sections after the drive member has been withdrawn.
Figure 15:
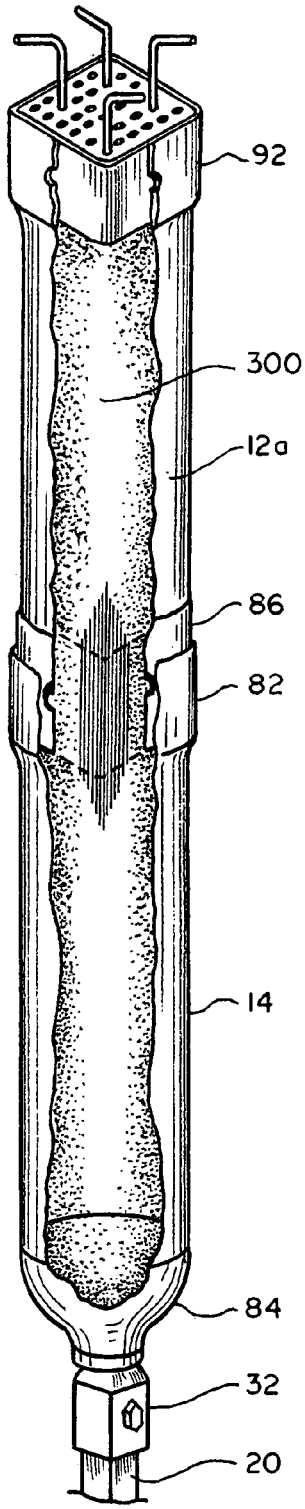
FIG. 15 is a cutaway view illustrating the pile sections of FIG. 15 filled with self-hardening filler material.
Figure 16:
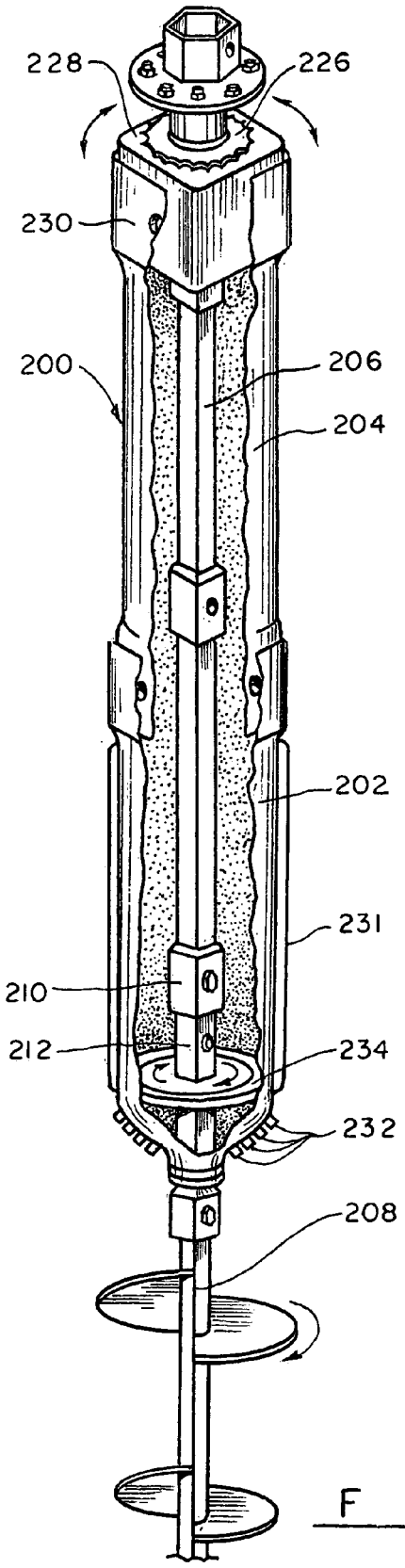
FIG. 16 is a perspective view illustrating a second embodiment of the anchor piling apparatus in accordance with the present invention wherein the drive member is rotated separately from the pile sections.
Figure 17:
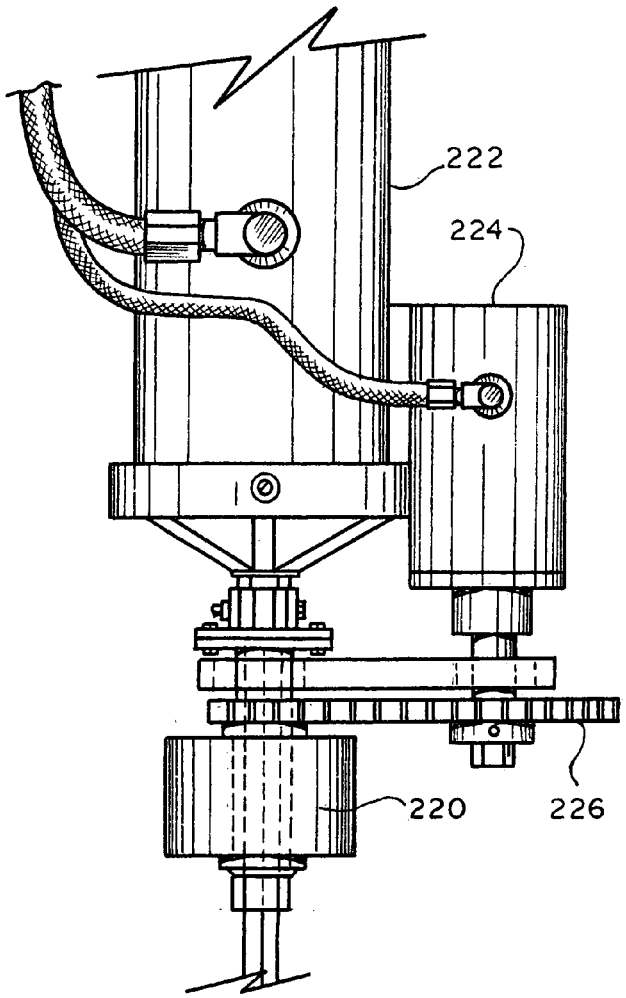
FIG. 17 is a detail view illustrating two power sources for transmitting torque separately to the drive member and to the pile sections.
Figure 18:
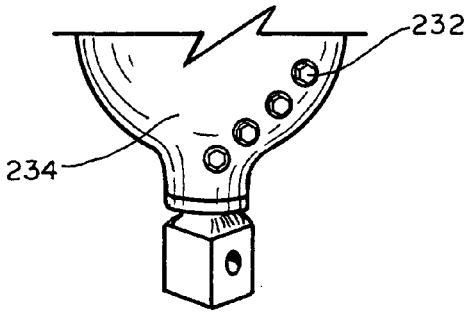
FIG. 18 is a detail view showing soil cutting teeth projections mounted on the conical portion of the transition section.

Referring now to FIGS. 13-15 a method of installing a pile using the apparatus of the present invention is illustrated. Initially, the helical anchor is driven into the soil and torque is imparted to the drive member, which is operationally connected to the anchor. The anchor and the transition section are driven into the ground, pulling one of the pile sections into the formed well. If the second embodiment of the present invention is used, torque is separately applied to the pile section causing its independent rotation and advancement into the soil. One or more sections of the drive member and the pile sections are added, if necessary until the pile reaches a competent soil.

The rotation force is then terminated and an upward force is applied to the drive member, severing the shear pin and disconnecting the drive member from the anchor. The drive member has been completely removed and saved for use with another set of hollow pile sections. The pile sections, along with the anchor and the transition section remain embedded in the soil, with an interior of the hollow pile sections being ready to receive a filler material, for instance a self-hardening substance, such as grout or cement. The operator then pours cement or grout or other reinforcing substance 300 into the pile sections 12. If desired, reinforcing rebars or post tension cables can be positioned in the pile sections 12 and secured with a cementing substance 300 for reinforcing the structure per the engineering specifications.

Because the interior of the pile sections has varying configuration, from round to square, the concrete 300, following the shape of the internal cavity, will take different configurations as well. It is envisioned that such different configuration concrete pile will provide a stronger bond to the internal support structure as compared to a conventional round pile having smooth, uniform cross-section interior. Additionally, since the cross-sectional areas of the pile increase from the bottom to the upper section, the shape of the concrete pile will be different, which will facilitate stronger support for the structure that uses the pile apparatus of the present invention.

Many changes and modifications can be made in the design of the present invention without departing from the spirit thereof. I therefore pray that my rights to the present invention be limited only by the scope of the appended claims.

I claim:

1. A method of installing a piling system comprising the steps of:

providing a plurality of hollow pile sections, a helical anchor secured to a first pile section, and a drive member extending through the pile sections and operationally connected to the helical anchor at its lower end and to a source of rotational force at its upper end;

thrusting the helical anchor into the soil;

imparting rotation force on the drive member and the anchor, thereby driving the anchor and the first pile section into the soil;

connecting one or more pile sections to the first pile section, while the anchor is being driven deeper into the soil until a pre-determined depth has been reached;

imparting rotational force to said pile sections independently from rotation of the drive member, thereby facilitating soil penetration and compaction as the pile sections advance into the soil; and severing a connection between the drive member and the anchor and removing the drive member from the pile sections.

2. A method of installing a piling system comprising the steps of:

providing a plurality of hollow pile sections, a helical anchor secured to a first pile section, and a drive member extending through the pile sections and operationally connected to the helical anchor at its lower end and to a source of rotational force at its upper end;

thrusting the helical anchor into the soil;

imparting rotation force on the drive member and the anchor, thereby driving the anchor and the first pile section into the soil;

connecting one or more pile sections to the first pile section, while the anchor is being driven deeper into the soil until a pre-determined depth has been reached;

severing a connection between the drive member and the anchor and removing the drive member from the pile sections; and providing a shear pin at the point of connection between the drive member and the anchor, and wherein the upwardly directed force severs the shear pin, allowing the drive member to be withdrawn from the pile sections.

3. A method of installing a piling system comprising the steps of:

providing a plurality of hollow pile sections, a helical anchor secured to a first pile section, and a drive member extending through the pile sections and operationally connected to the helical anchor at its lower end and to a source of rotational force at its upper end;

thrusting the helical anchor into the soil;

imparting rotation force on the drive member and the anchor, thereby driving the anchor and the first pile section into the soil;

connecting one or more pile sections to the first pile section, while the anchor is being driven deeper into the soil until a pre-determined depth has been reached;

severing a connection between the drive member and the anchor and removing the drive member from the pile sections; and wherein a plurality of longitudinal outwardly extending ribs is secured on an outside surface of the lowermost pile section, said ribs facilitating soil penetration and compaction as the pile sections advance into the soil.

4. A method of installing a piling system comprising the steps of:

providing a plurality of hollow pile sections, a helical anchor secured to a first pile section, and a drive member extending through the pile sections and operationally connected to the helical anchor at its lower end and to a source of rotational force at its upper end;

thrusting the helical anchor into the soil;

imparting rotation force on the drive member and the anchor, thereby driving the anchor and the first pile section into the soil;

connecting one or more pile sections to the first pile section, while the anchor is being driven deeper into the soil until a pre-determined depth has been reached;

severing a connection between the drive member and the anchor and removing the drive member from the pile sections; and wherein a plurality of teeth is secured on an outside surface of the lowermost pile section, said teeth facilitating soil penetration and compaction as the pile sections advance into the soil.

5. An anchor pile apparatus comprising:

a plurality of hollow pile sections adapted for connecting end-to-end in a substantially co-axial relationship to each other;

a helical anchor secured to a lowermost pile section; and a drive member extending through the pile sections and having an upper end being adapted for connecting to a power source, said drive member and said helical anchor being adapted to receiving rotational force from said power source, said drive member and said helical anchor being operationally connected to each other at a point of connection located in the lowermost pile section, such that an upwardly directed force applied to the drive member severs the connection between the drive member and the helical anchor member, allowing substantially all drive member to be retrieved for subsequent re-use, and wherein a plurality of longitudinal outwardly extending ribs is secured on an outside surface of the lowermost pile section, said ribs facilitating soil penetration and compaction as the pile sections advance into the soil.

6. An anchor pile apparatus comprising:

a plurality of hollow pile sections adapted for connecting end-to-end in a substantially co-axial relationship to each other;

a helical anchor secured to a lowermost pile section; and a drive member extending through the pile sections and having an upper end being adapted for connecting to a power source, said drive member and said helical anchor being adapted to receiving rotational force from said power source, said drive member and said helical anchor being operationally connected to each other at a point of connection located in the lowermost pile section, such that an upwardly directed force applied to the drive member severs the connection between the drive member and the helical anchor member, allowing substantially all drive member to be retrieved for subsequent re-use, and wherein a plurality of teeth is secured on an outside surface of the lowermost pile section, said teeth facilitating soil penetration and compaction as the pile sections advance into the soil.

7. An anchor pile apparatus comprising:

a plurality of hollow pile sections adapted for connecting end-to-end in a substantially co-axial relationship to each other;

a helical anchor secured to a lowermost pile section, said helical anchor has an anchor shaft carrying a plurality of spaced helical cutting elements for penetrating into the soil, wherein said anchor shaft has a substantially rectangular cross-section; and a drive member extending through the pile sections and having an upper end being adapted for connecting to a power source, said drive member and said helical anchor being adapted to receiving rotational force from said power source, said drive member and said helical anchor being operationally connected to each other at a point of connection located in the lowermost pile section, such that an upwardly directed force applied to the drive member severs the connection between the drive member and the helical anchor member, allowing substantially all drive member to be retrieved for subsequent re-use.

8. An anchor pile apparatus comprising:

a plurality of hollow pile sections adapted for connecting end-to-end in a substantially co-axial relationship to each other;

a first power source for imparting rotation to said plurality of pile sections;

a helical anchor secured to a lowermost pile section;

a second power source for imparting rotation to the anchor; and a drive member extending through the pile sections and operationally connected to the anchor for transmitting rotational force from said second power source to the anchor.

9. The apparatus of claim 8, wherein said first power source and said second power source have independent drives such that rotational force imparted on the pile sections is independent from the rotational force imparted on the anchor.

10. The apparatus of claim 8, wherein a gear assembly is mounted between said second power source and the drive member.

11. The apparatus of claim 8, wherein a plurality of longitudinal outwardly extending ribs is secured on an outside surface of the lowermost pile section, said ribs facilitating soil penetration and compaction as the pile sections advance into the soil.

12. The apparatus of claim 8, wherein a plurality of teeth is secured on an outside surface of the lowermost pile section, said teeth facilitating soil penetration and compaction as the pile sections advance into the soil.

13. The apparatus of claim 8, wherein said drive member and said helical anchor are connected to each other at a point of connection located in the lowermost pile section, such that an upwardly directed force applied to the drive member severs the connection between the drive member and the helical anchor member, allowing substantially all drive members to be retrieved for subsequent re-use.

14. The apparatus of claim 8, wherein each of said plurality of pile sections has a lower male connector end and a top female connector end, wherein a lower end of each of said plurality of pile sections telescopically fittingly engages within a top connector end of an adjoining pile section.

15. The apparatus of claim 8, wherein said pile sections have increasingly greater cross-sectional areas from the lowermost pile section to an uppermost pile section.

16. The apparatus of claim 15, further comprising an adapter sleeve mounted about a lower end and an upper end of adjoining hollow pile sections so as to facilitate smooth transition between the adjoining pile sections having different size cross-sectional areas.

* * * * *